US006322414B1

(12) United States Patent
Lin

(10) Patent No.: US 6,322,414 B1
(45) Date of Patent: Nov. 27, 2001

(54) UNIVERSAL BLOCKS

(75) Inventor: Fu-Chi Lin, Taipei Hsien (TW)

(73) Assignee: Youth Toy Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/649,719

(22) Filed: Aug. 28, 2000

(51) Int. Cl.[7] ..... A63H 33/08

(52) U.S. Cl. ..... 446/122; 446/126; 446/86; 446/85

(58) Field of Search ..... 446/122, 121, 446/123, 120, 125, 126, 85, 86

(56) References Cited

U.S. PATENT DOCUMENTS

| | | | | |
|---|---|---|---|---|
| 1,216,840 | * | 2/1917 | Ramsey et al. | 446/122 |
| 2,493,435 | * | 1/1950 | Archambault | 446/126 |
| 5,013,245 | * | 5/1991 | Benedict | 446/122 |

* cited by examiner

*Primary Examiner*—Jacob K. Ackun, Jr.
*Assistant Examiner*—Shaquita McConnell
(74) *Attorney, Agent, or Firm*—Pro-Techtor International Services

(57) ABSTRACT

A set of universal blocks includes a plurality of uniform-sized cubic elements, a plurality of uniform-sized connecting elements, and at least one disassemble aid. The cubic element each is provided at all six sides with an insertion hole each. The connecting element each is adapted to insert into the insertion holes on the cubic elements and has a length twice or almost twice as long as that of the insertion holes. The disassemble aid is a long flat element provided with a plurality of through holes adapted to easily disassemble the connecting elements from the cubic elements. The cubic elements may be freely connected to one another via the connecting elements to create a variety of two-dimensional and three-dimensional geometric shapes, and be conveniently used to play various kinds of games, including puzzles.

3 Claims, 9 Drawing Sheets

UNIVERSAL BLOCKS

BACKGROUND OF THE INVENTION

The present invention relates to a set of blocks, and more particularly to a set of universal blocks including a plurality of uniform-sized cubic elements, a plurality of uniform-sized connecting elements, and at least one disassemble aid. The cubic elements may be freely connected to one another via the connecting elements to create a variety of two-dimensional and three-dimensional geometric shapes and be used to play many games, such as puzzles.

There are many intellectual games or toys developed and sold in the market. Among these games, puzzles consisting of uniquely shaped elements, such as the currently very popular Magic Assembled Cube, Fantastic Geometrical Column, Varied Shapes with Same Area, etc., are widely welcomed by consumers. These puzzles and games have their own particularly designed elements and are not exchangeable among different games or puzzles. That is, consumers need to pay a lot of money to purchase many different sets of blocks or puzzles to enjoy different games and need a large room to store the blocks or puzzles when they are not in use. On the other hand, conventional blocks usually have at least one projected connecting bar integrally formed on the blocks. Some of these connecting bars would project from the geometric shapes assembled from the blocks and have adverse influence on the overall appearance of the assembled shapes. These connecting bars also prevent the conventional blocks from being used as elements for puzzles.

The well-known Lego cubes also include a fixed tenon on each block and therefore could not be used in games such as puzzles.

It is therefore tried by the inventor to develop a set of universal blocks that may be used not only to freely create a variety of geometric shapes but also to play many kinds of puzzles.

SUMMARY OF THE INVENTION

A primary object of the present invention is to provide a set of universal blocks including a plurality of uniform-sized cubic elements, a plurality of uniform-sized connecting elements, and at least one disassemble aid. The cubic elements may be freely connected to one another via the connecting elements to create a variety of two-dimensional and three-dimensional geometric shapes and be used to play many games, such as puzzles.

Another object of the present invention is to provide a set of universal blocks that may be used with other conventional blocks, including Lego cubes, to make geometric shapes assembled from the conventional blocks have even outer surfaces.

To achieve the above and other objects, the set of universal blocks of the present invention mainly includes a plurality of uniform-sized cubic elements, a plurality of uniform-sized connecting elements, and at least one disassemble aid. The cubic element each is provided at all six sides with an insertion hole each; the connecting element each is adapted to insert into the insertion holes on the cubic elements and has a length twice or almost twice as long as that of the insertion holes; and the disassemble aid is a long flat element provided with a plurality of through holes adapted to engage with the connecting elements. The cubic elements may be freely connected to one another via the connecting elements to create a variety of two-dimensional and three-dimensional geometric shapes, and be conveniently used to play various kinds of games, including puzzles. By pressing one end of the disassemble aid against a shape assembled from the cubic elements and the connecting elements with one or more of the through holes on the disassemble aid aligned with one or more of the connecting elements projected from the cubic elements and then pivotally turn the disassemble aid upward, the connecting elements can be easily disassembled from the cubic elements.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
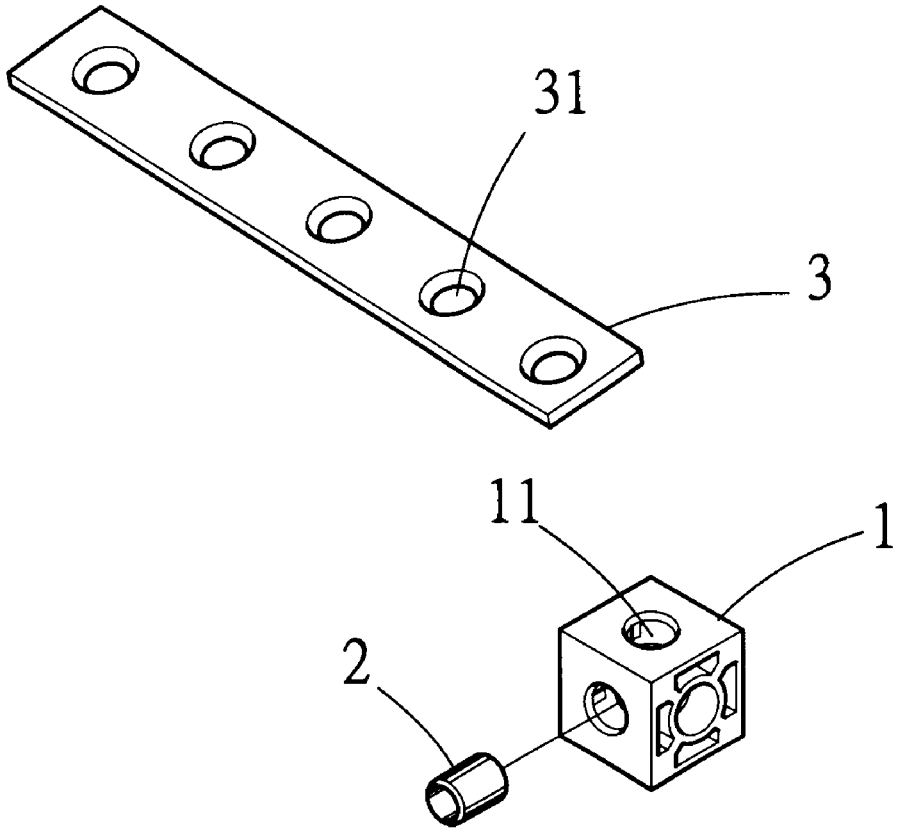
FIG. 1 is a perspective showing three basic elements of the present invention.

The present Invention relates to a set of universal blocks. Please refer to FIG. 1 that is a perspective view showing three basic elements of this set of blocks, namely, a cubic element 1 being provided at all six sides thereof with an insertion hole 11 each, preferably round in cross section, a connecting element 2 in the form of a short cylinder having a length twice or almost twice as long as the insertion hole 11 and adapted to insert into the insertion hole 11 on the cubic element 1; and a disassemble aid 3 in the form of a flat long member provided with several round through holes 31 adapted to each engage with a connecting element 2. In one set of the universal blocks, there are a plurality of cubic elements 1 that are uniform in size, a plurality of connecting elements 2 that are uniform in size, and at least one disassemble aid 3.

Figure 2:
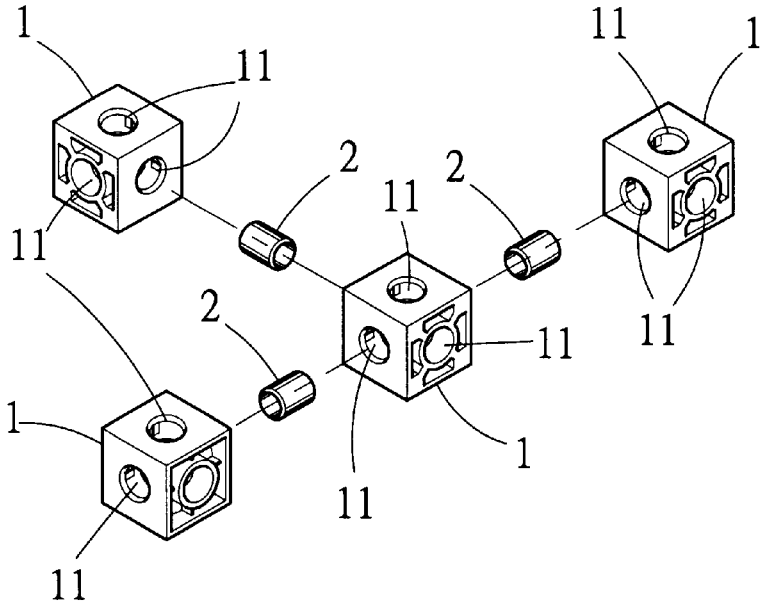
FIG. 2 is a perspective exemplifying the connection of different elements of the present invention to one another.
Figure 3:
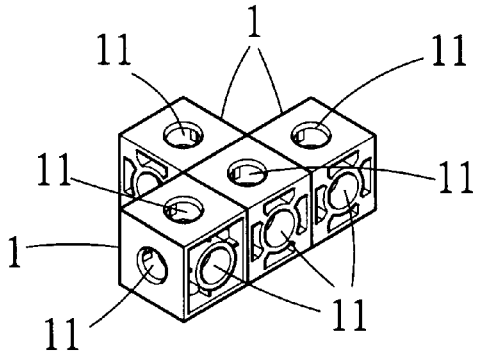
FIG. 3 is a perspective of a geometric shape assembled from the elements of FIG. 2.

Please refer to FIGS. 2 and 3 that exemplify the manner of connecting multiple cubic elements 1 to one another by means of multiple connecting elements 2. As mentioned above, the connecting element 2 each is adapted to insert into the insertion hole 11 on the cubic element 1. By separately inserting two ends of a connecting element 2 into two insertion holes 11 on two different cubic elements 1, the two cubic elements 1 are connected to abut on each other at one side thereof. More cubic elements 1 can be connected via the connecting elements 2 in different directions to form different geometric shapes. The geometric shape formed from the cubic elements 1 and the connecting elements 2 in FIG. 2 is close to a letter "T", as shown in FIG. 3.

Figure 4:
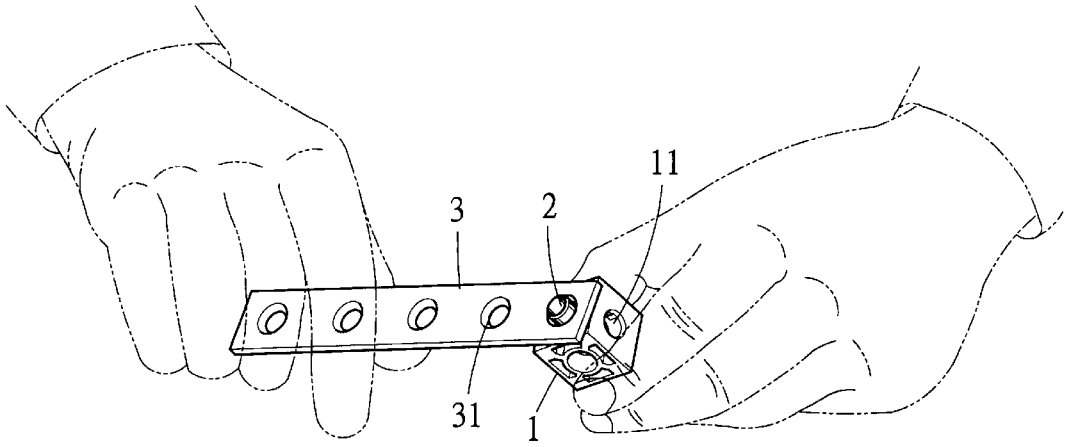
FIG. 4 shows the manner of disassembling two different elements from each other with a disassemble aid of the present invention.

Please refer to FIG. 4. The disassemble aid 3 of the present invention is used to disassemble the connecting elements 2 from the insertion holes 11 of the cubic elements 1. To do so, first firmly press an end of the disassemble aid 3 against a shape assembled from the cubic elements 1 and align one or more of the round through holes 31, preferably the one closest to an end of the long disassemble aid 3, with one or more connecting elements 2 that are to be disassembled from insertion holes 11 on the cubic elements 1. Then, pivotally lift the other end of the disassemble aid 3 with the cubic elements 1 as a fulcrum. The connecting elements 2 would be easily disassembled from the insertion holes 11 on the cubic elements 1.

Figure 5:
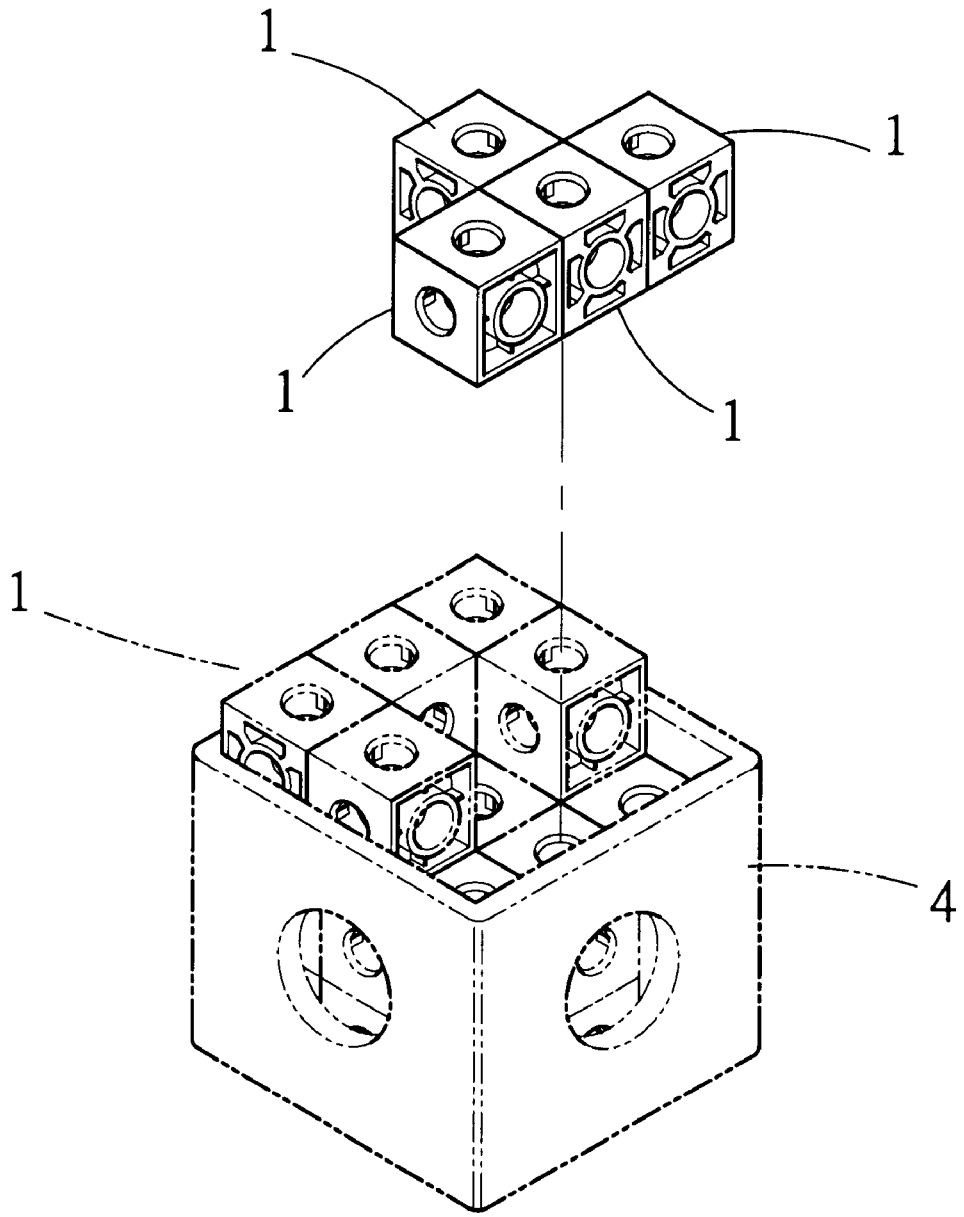
FIG. 5 exemplifies the connection of multiple cubic elements to one another by means of connecting elements to play a puzzle named Magic Assembled Cube.
Figure 6:
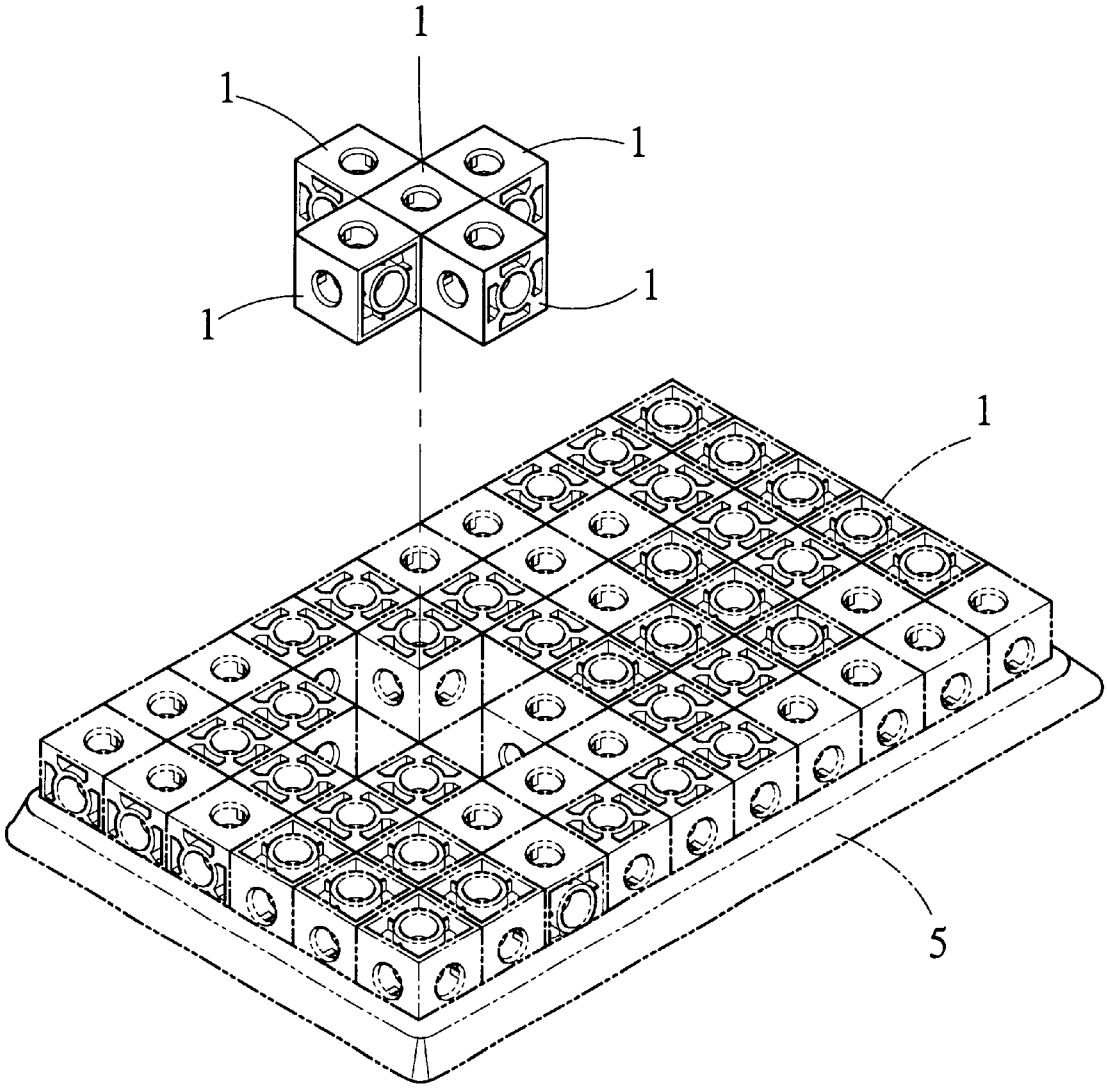
FIG. 6 exemplifies the connection of multiple cubic elements to one another by means of connecting elements to play a puzzle named Varied shapes with Same Area.
Figure 7:
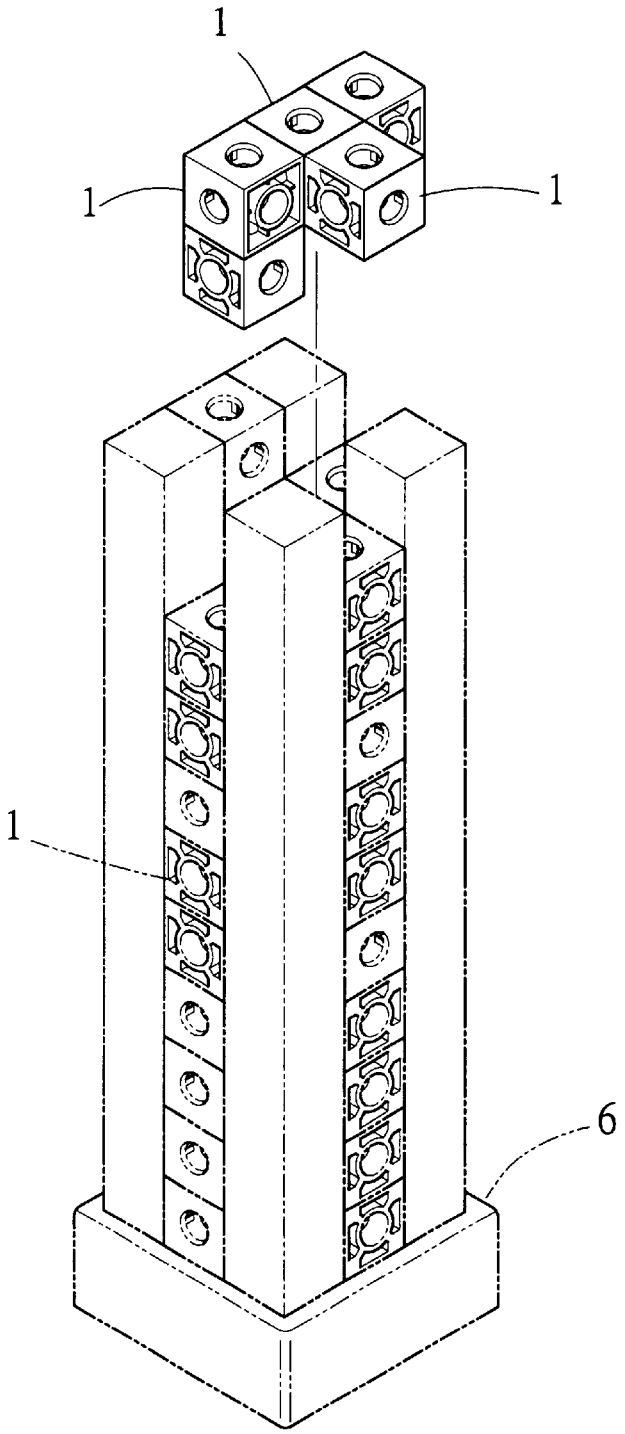
FIG. 7 exemplifies the connection of multiple cubic elements to one another by means of connecting elements to play a puzzle named Fantastic Geometric Column.

With the above-described simple way of connecting two cubic elements 1 to each other via the connecting element 2, it is possible to freely create various kinds of two-dimensional and three-dimensional geometric shapes. The elements 1 of the present invention may be used together with some other devices to create more fun. For instance, in FIG. 5, there is shown a base box 4 that defines a cubic space therein. The cubic elements 1 of the present invention may be differently connected and sequentially put into the base box 4 to finally form a cubic block. This is a puzzle played in a three-dimensional space and named Magic Assembled Cube. And, in FIG. 6, there is shown a rectangular tray 5 that defines a flat shallow space therein. The cubic elements 1 of the present invention may be differently connected and sequentially put into the shallow tray 5 to finally fill the whole tray 5. This is a puzzle played in a two-dimensional space and named Varied Shapes with Same Area. And, in FIG. 7, there is shown a base 6 with four upward extended posts to define a space having a cruciform cross section. The cubic elements 1 of the present invention may be differently connected with the connecting elements 2 and sequentially put into the cruciform space to finally fill the same. This is another puzzle played in a three-dimensional space and named Fantastic Geometric Column. In the process of filling the above different devices 4, 5 and 6 with the cubic elements 1 of the present invention, a lot of different geometric shapes may be created with funs.

Figure 8:
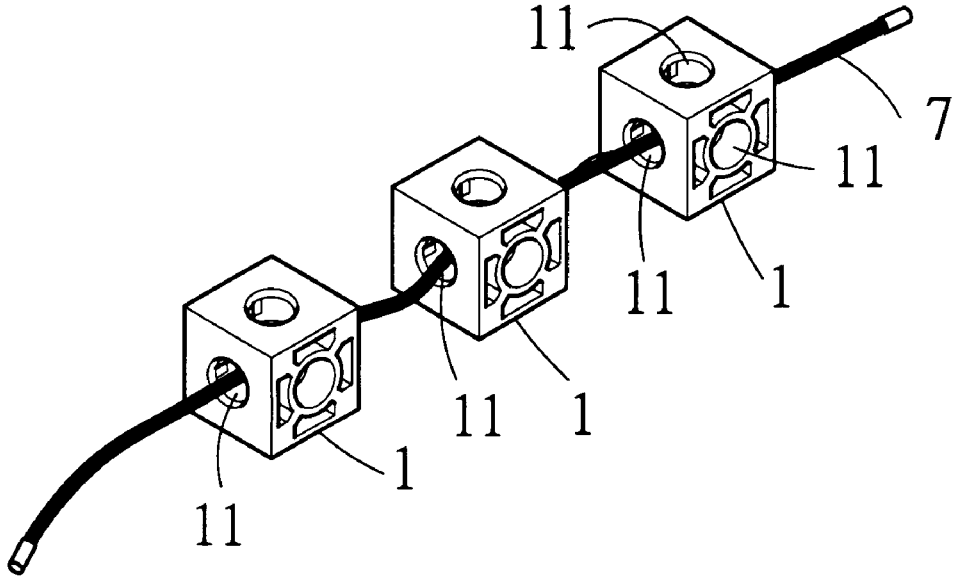
FIG. 8 exemplifies the serial connection of multiple cubic elements by threading a string through insertion holes provided on the cubic elements.

As described above, the cubic element 1 each is a small cube with all six sides thereof provided with an insertion hole 11 each. The six insertion holes 11 in one cubic element 1 are communicable with one another inside the cubic element 1. A string 7 or the like may be sequentially threaded through a plurality of cubic elements 1 to serially connect them together, as shown in FIG. 8.

Figure 9:
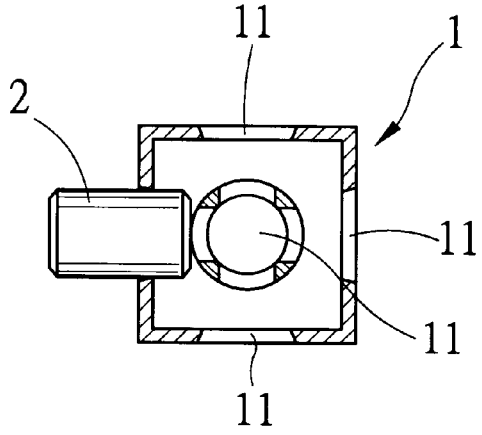
FIG. 9 is a sectional view of the cubic element and the connecting element of the present invention.

FIG. 9 is a sectional view of the cubic element 1 with a connecting element 2 inserted into an insertion hole 11. As described above, there is an insertion hole 11 centered at each side of the cubic element 1, and therefore, total six insertion holes 11 are provided on one cubic element 1. It can be seen from FIG. 9 that each of the insertion holes 11 has an inward tapered peripheral wall. When the connecting element 2 is inserted into the insertion hole 11, it would be finally stopped from moving inward any further. At this point, a portion of the connecting element 2 that remains located outside the cubic element 1 has a length equal to or slightly shorter than a full length of the insertion hole 11.

Figure 10:
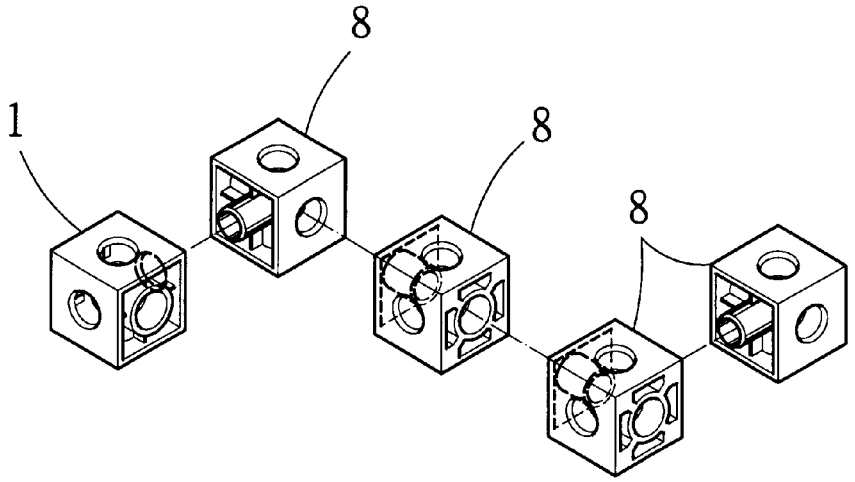
FIG. 10 shows the connection of the cubic elements of the present invention to the conventional Lego cubes.
Figure 11:
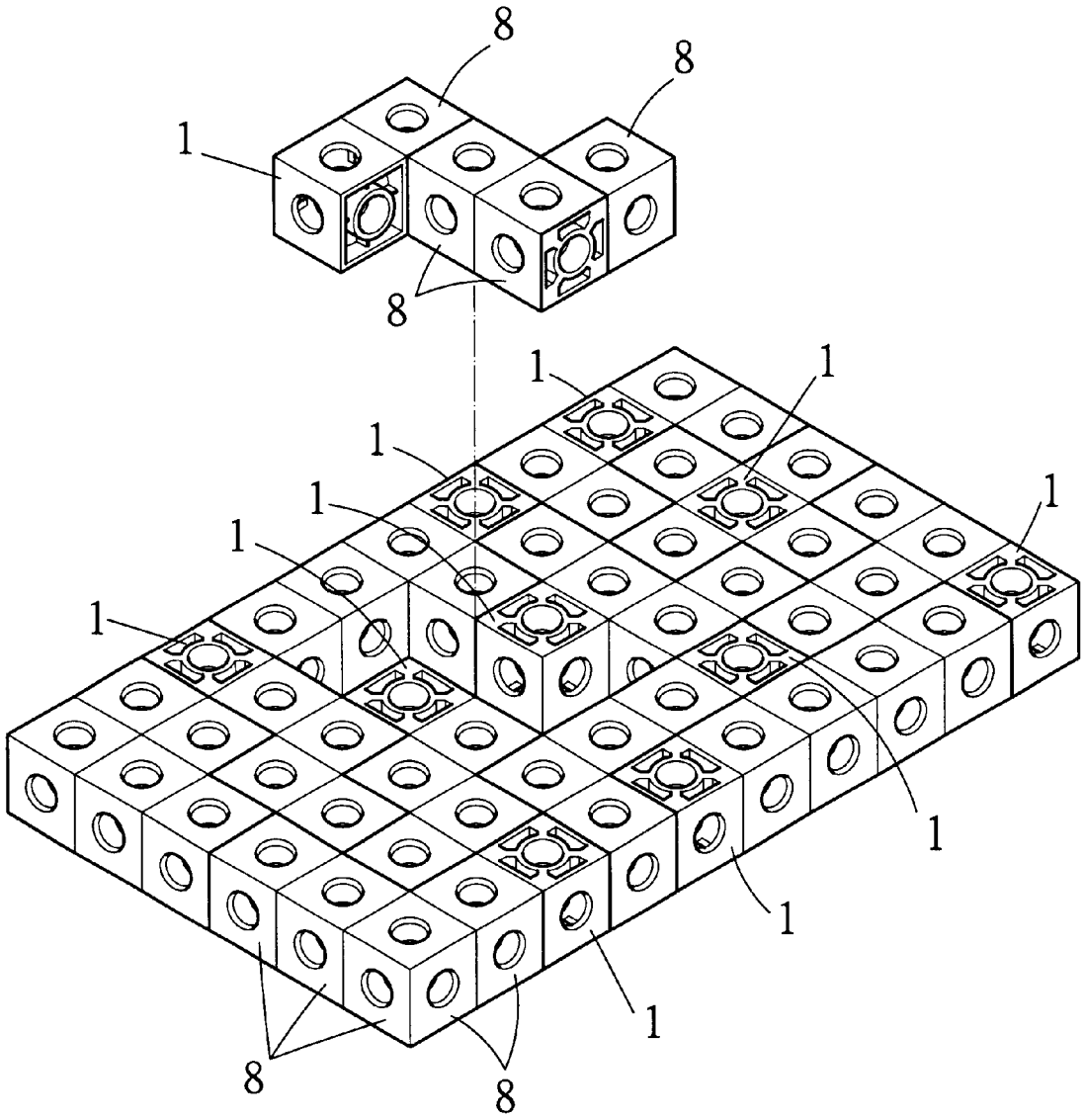
FIG. 11 exemplifies the use of the cubic elements of the present invention with the Lego cubes to play the puzzle named Varied Shapes with Same Area.

With the above arrangements, connection of any number of cubic elements 1 together via any number of connecting elements 2 allows the cubic elements 1 to freely extend in any direction to create a variety of two-dimensional and three-dimensional geometric shapes. The blocks according to the present invention may also be used with the popular Lego cubes. Please refer to FIG. 10, each of the Lego cubes 8 usually has an insertion bar projected from one side thereof. The cubic element 1 of the present invention may be connected to a Lego cube 8 by inserting the insertion bar on the Lego cube 8 into one insertion hole 11 on the cubic element 1. Thereby, insertion bars projected from outer surfaces of a shape assembled from many Lego cubes 8 may be connected to cubic elements 1 of the present invention for the assembled shape of Lego cubes to have even outer surfaces. FIG. 11 also exemplifies the use of the cubic elements 1 with the Lego cubes 8 in the puzzle of Varied Shapes with Same Area.

The following are some of the advantages of the blocks of the present invention:

1. A variety of three-dimensional and two-dimensional shapes may be created from only one single type of block,
2. The assembled cubic elements and the connecting elements can be easily disassembled from one another with the disassemble aid.
3. The cubic elements of the present invention maybe used to play various kinds of intellectual games developed for children and adults. Consumers need not to purchase many different types of blocks separately designed for different games and can therefore save a lot of money.
4. The cubic elements of the present invention may be connected to the popular Lego cubes to make the shapes assembled from the Lego cubes have even outer surfaces and therefore looked more attractive.

What is claimed is:

1. A set of universal blocks comprising a plurality of uniform-sized cubic elements, a plurality of uniform-sized connecting elements, and at least one disassemble aid;

each of said cubic elements being provided at all six sides with an insertion hole, each insertion hole having a length;

each of said connecting elements being a cylindrical member having ends adapted to insert into said insertion holes on said cubic elements, said connecting elements each having a length twice or almost twice as long as that of said insertion holes; and said disassemble aid being a long flat element provided with a plurality of through holes adapted to engage with said connecting elements, such that when said disassemble aid is pressed at one end against a shape assembled from said cubic elements and said connecting elements with one or more of said through holes on said disassemble aid aligned with one or more of said connecting elements projected from said cubic elements and then lifted upward at the other end, said connecting elements could be easily disassembled from said insertion holes on said cubic elements;

whereby when a plurality of said cubic elements are connected to one another via said connecting elements, a variety of two-dimensional and three-dimensional geometric shapes may be created, and various kinds of games, may be enjoyed.

2. A set of universal blocks as claimed in claim 1, wherein said insertion holes on said cubic elements have a round cross section, and said connecting elements is a bar or a tube having a round cross section.

3. A set of universal blocks as claimed in claim 1, wherein said insertion holes on said cubic elements are communicable with one another inside said cubic elements, such that said cubic elements maybe serially connected by a string.

* * * * *